US006640359B1

(12) United States Patent
Alane

(10) Patent No.: US 6,640,359 B1
(45) Date of Patent: Nov. 4, 2003

(54) YOGA MAT

(76) Inventor: Dawnn Alane, 16101 W. Sunset Blvd., #203, Pacific Palisades, CA (US) 90272

( * ) Notice: Subject to any disclaimer, the term of this patent is extended or adjusted under 35 U.S.C. 154(b) by 0 days.

(21) Appl. No.: 10/245,570

(22) Filed: Sep. 17, 2002

(51) Int. Cl.[7] ..... A47G 9/06
(52) U.S. Cl. ..... 5/420; 5/417
(58) Field of Search ..... 5/417, 418, 420, 5/419

(56) References Cited

U.S. PATENT DOCUMENTS 4,450,193 A * 5/1984 Staebler ..... 428/71
5,203,041 A * 4/1993 Alonso ..... 5/420
5,291,625 A * 3/1994 Leslie ..... 5/420
5,386,603 A * 2/1995 Drust ..... 5/417
5,437,569 A * 8/1995 Ming ..... 441/129
5,740,566 A * 4/1998 Stacy ..... 5/420
6,061,849 A * 5/2000 Seals ..... 5/417
6,202,235 B1 * 3/2001 Salhanick ..... 5/653
6,212,711 B1 * 4/2001 Gilmour ..... 5/420

OTHER PUBLICATIONS

Hugger Mugger, "yoga products Fall 2002," Hugger Mugger (Salt Lake City, Utah).

* cited by examiner

*Primary Examiner*—Teri Pham Luu
(74) *Attorney, Agent, or Firm*—Sanford Astor

(57) ABSTRACT

A yoga mat that is able to be rolled up tightly and then held closed by two straps being wrapped around the rolled up mat. The straps are part of the piece of mat material from which the mat is manufactured and are made by cutting sections from the end of the mat, thereby leaving one end of each strap as part of the original material. A shoulder strap is attached, between the two straps, so that the mat can be carried over the shoulder with both hands and arms free.

9 Claims, 3 Drawing Sheets

YOGA MAT

BACKGROUND OF THE INVENTION

Yoga has always been a popular exercise for many people. Today it has become even more popular and is practiced by thousands of people in the United States alone. Nearly every person going to a yoga class brings their own yoga mat. Most persons have great difficulty in carrying their yoga mat along with their purses, backpacks, keys, towels, books, computers, etc., primarily due the fact that it is quite difficult to keep their yoga mat rolled up tightly enough to stay under their arm without sliding down and eventually unrolling and falling to the ground.

While yoga backpacks do exist, they are too much trouble because you have to carefully fold and unfold the yoga mat just to get it in and out of the backpack. In addition, after several classes the yoga mat may not be the sweetest smelling item, due to sweat and body odor, and stuffing them into a carry bag and being stored there does not allow fresh air to clean the odor. The yoga mat of this invention is simple, quick and easy to roll up and carry and to roll out for class.

BRIEF SUMMARY OF THE INVENTION

Applicant's invention comprises a yoga mat that is able to be rolled up tightly and then tied closed, so that it will not unroll, and that also has a shoulder strap attached so that the mat can be carried like a purse, briefcase or bag, with both hands and arms free. The securing straps that close and hold the mat securely rolled up are made of the same material as the mat and are indeed, just an extension of the mat, rather than being added. The shoulder strap is positioned in the center of the securing straps so as not to obstruct the user or the teacher.

The yoga mat of this invention is washable. It easily rolls and unrolls with two streamlined straps which are actually a part of the mat. The straps roll around the rolled up mat and connect with a hook and loop fastener (Velcro), or other closure, with just a sweep of the hand. A shoulder handle enables the user to sling the rolled up mat over his or her shoulder and have both arms and hands free.

OBJECTS OF THE INVENTION

Accordingly, several objects and advantages of the invention are as follows:

It is an object of the present invention to provide a yoga mat which is easily rolled up for easy carrying and transportation.

Another object of the invention is to provide a yoga mat in which straps which are a part of the mat, are used to hold the mat in its rolled up state.

These, as well as other objects of the invention, will become obvious from the following description in which:

DETAILED DESCRIPTION OF THE INVENTION

Figure 1:
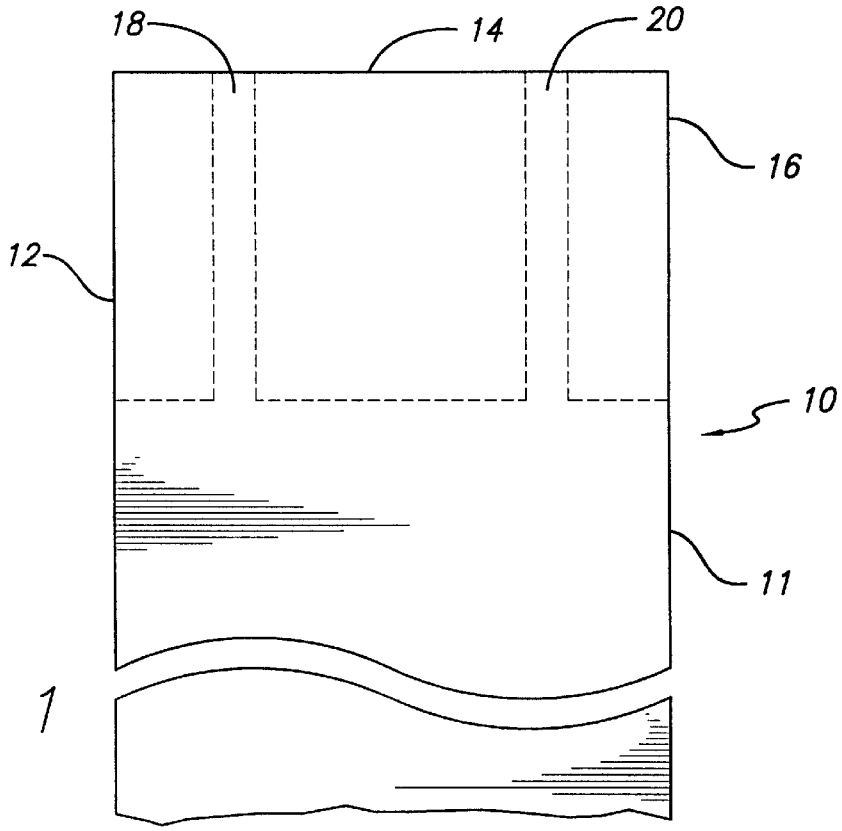
FIG. 1 is a top plan view of the material of the yoga mat prior to cutting.

Referring now to the drawings there is shown a generally rectangular piece of mat material 10, which will be the yoga mat 11, with dotted lines outlining three areas of material to be cut-out from the piece of mat material 10. The rectangular piece of mat material 10 is longer than is required for the resulting mat 11. The three cut-outs 12, 14 and 16, when cuts are made through, and removed from the mat material 10, will create two narrow elongated straps 18 and 20. A carry strap 22 is fixedly attached to one end of yoga mat 11, between straps 18 and 20, such as by sewing.

To the ends of straps 18 and 20 is affixed a means of holding yoga mat 10 in the rolled up position. These are hook and loop fasteners 24 and 26. Fasteners 24 an 26 connect to hook and loop fasteners 28 and 30. As can be seen, fasteners 24 and 26 are on one side and one end of each strap and fasteners 28 and 30 are at the opposite end of each strap and on the opposite side of each strap, so that they can lock together when the mat is rolled up, as shown in FIG. 3.

Figure 3:
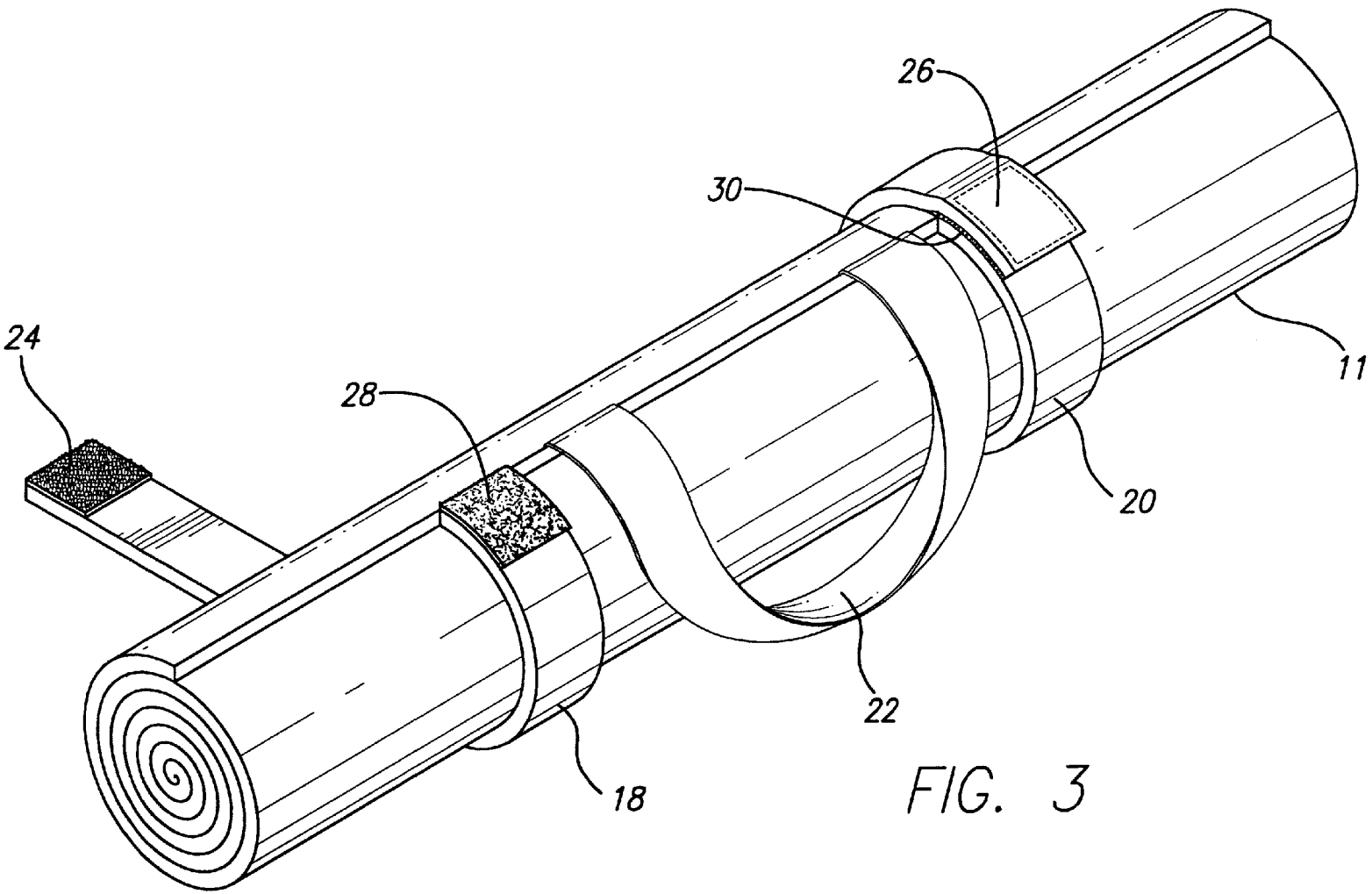
FIG. 3 is a perspective view of the rolled up mat.

As shown more clearly in FIG. 3, when yoga mat 11 is rolled up, straps 18 and 20 circle the rolled up mat 11 and attach at ends 24–28 and 26–30. Other fasteners could be used such as buttons, snaps or ties, however a hook and loop fastener is faster, easier and has some degree of adjustment if the mat 11 is not rolled up as tightly from one time to another.

Figure 4:
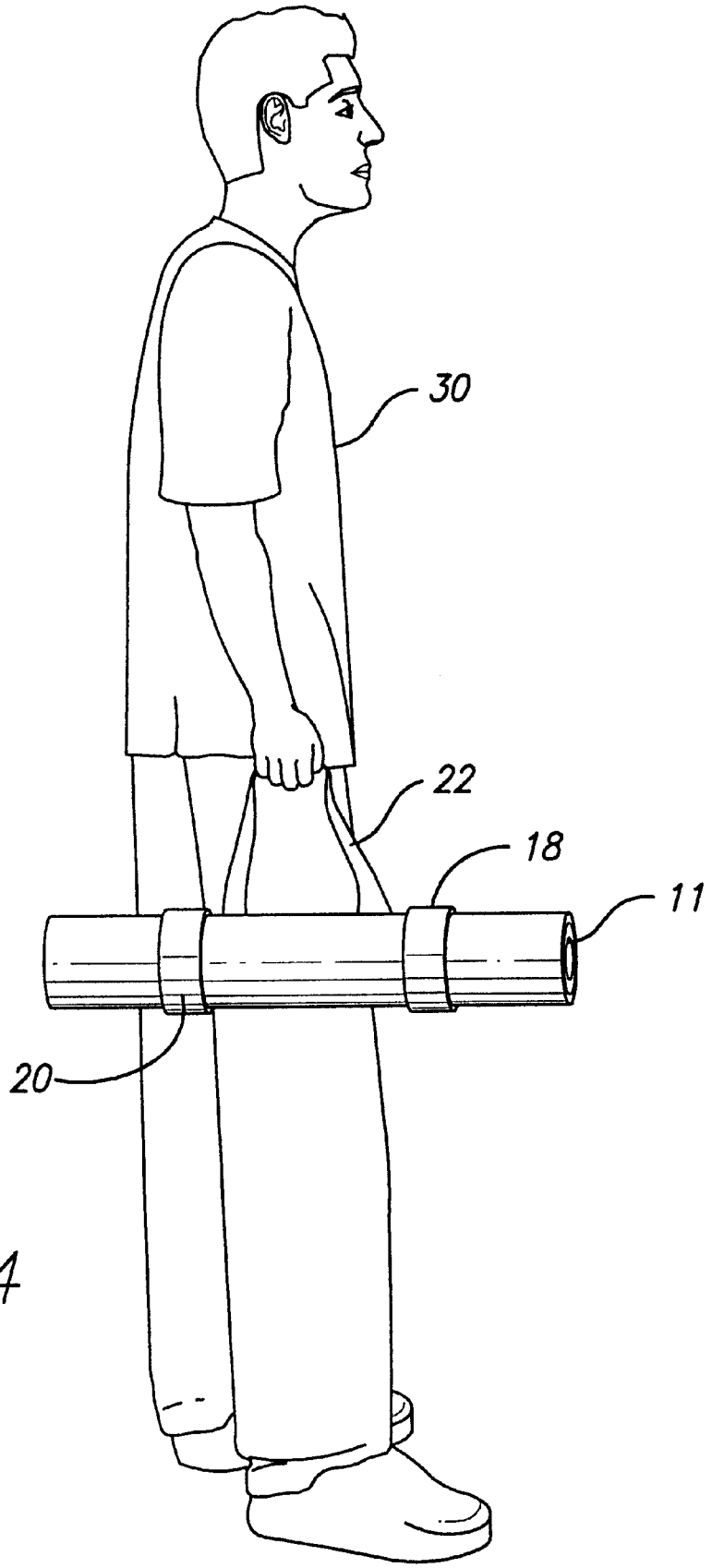
FIG. 4 is a depiction of a person carrying the mat.

FIG. 4 depicts a person 30 carrying yoga mat 11 by strap 22. Straps 18 and 20 are holding yoga mat 10 in its rolled up state. It can be seen that person 30 could also throw strap 22 over his shoulder and carry mat 11 in that manner, leaving his arms and hands free.

Figure 2:
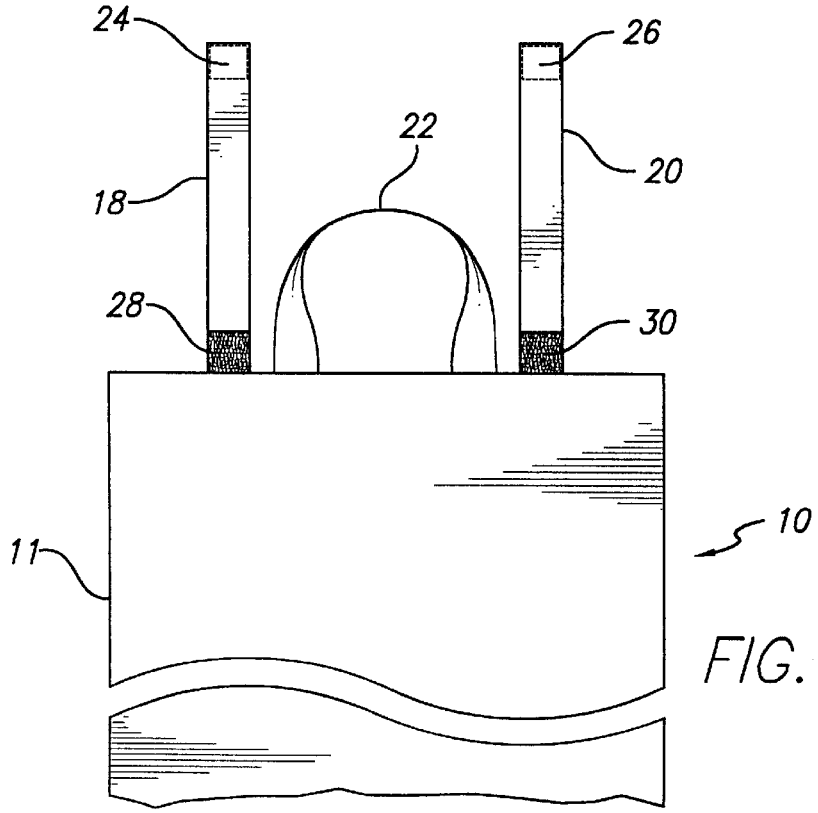
FIG. 2 is a top plan view after the cutting of the straps.

Referring to FIGS. 1 and 2, it can be seen that by cutting out the portions 12, 14,and 16 from the original piece of material 10, straps 18 and 20 remain part of the original starting material. They are not sewed on or affixed in any manner. This gives straps 18 and 20 more strength, since there is no worry about stitching coming loose or any other method of attachment of straps becoming undone.

Yoga mat 11 can be made from any usual substance from which exercise mats are made. The preferred material is a soft polyvinyl chloride, also known as a "closed-cell pvc vinyl". It is available from the Hugger Mugger Co. Of Salt Lake City, Utah. It is a particularly good material for yoga mats because it has a tacky, non-slick surface which prevents sliding on the surface of the mat. Sliding is not desirable when doing yoga.

A yoga mat manufactured as described herein, will last for years. It is durable, comfortable, completely washable, and the straps will never come loose. No sports bag, back pack, other carry bag or other accessories are needed to transport the yoga mat.

Having thus described the invention, I claim:

1. A generally rectangular one-piece yoga mat, comprising two generally rectangular, parallel, narrow elongated straps, for med monolithically with the mat said straps being long enough to completely encircle the rolled-up mat, one end of each strap located at the end of the mat, the other end of each strap having a fastener attached thereto, a shoulder length carry strap attached to the end of the mat between the two straps, means to removably attach the fastener ends of each strap to a coordinating fastener at the mat end of each strap, when the mat has been rolled up.

2. The mat of claim 1 in which each fastener is a hook and loop fastener.

3. The mat of claim 1 in which the mat is made from soft, tacky, non-slick polyvinyl chloride vinyl.

4. The mat of claim 1 in which the straps are created by cutting out three sections of the mat, leaving two narrow elongated straps.

5. The mat of claim 1 in which the carry strap is fixedly attached to the mat by sewing.

6. A method for manufacturing a generally rectangular, one-piece yoga mat from an elongated piece of mat material, comprising cutting out three sections from the elongated piece of mat material to form two generally rectangular, parallel elongated straps, both straps at one end thereby being an integral part of the mat itself, attaching a hook and loop fastener to both ends of each strap, and attaching a shoulder length carry strap to the end of the mat between the two elongated straps.

7. The method of claim 6 in which the mat is manufactured from soft, tacky, non-slick polyvinyl chloride vinyl.

8. The method of claim 6 in which the carry strap is fixedly attached to the mat by sewing.

9. The method of claim 6 comprising attaching the hook and loop fasteners to one end on one side of each elongated strap and on the opposite end and opposite side of each elongated strap so that they can lock together when the mat is rolled up.

* * * * *